US007299860B2

(12) United States Patent
Touzov

(10) Patent No.: US 7,299,860 B2
(45) Date of Patent: Nov. 27, 2007

(54) INTEGRAL FASTENER HEAT PIPE

(76) Inventor: Igor Victorovich Touzov, 311 Castle Hayne Dr., Cary, NC (US) 27519

( * ) Notice: Subject to any disclaimer, the term of this patent is extended or adjusted under 35 U.S.C. 154(b) by 128 days.

(21) Appl. No.: 11/307,125

(22) Filed: Jan. 24, 2006

(65) Prior Publication Data

US 2007/0251672 A1 Nov. 1, 2007

Related U.S. Application Data

(63) Continuation-in-part of application No. 11/306,529, filed on Dec. 30, 2005, and a continuation-in-part of application No. 11/306,530, filed on Dec. 30, 2005, and a continuation-in-part of application No. 11/307,051, filed on Jan. 20, 2006.

(51) Int. Cl.
*F28D 15/02* (2006.01)

(52) U.S. Cl. ..... 165/104.26; 165/185; 165/104.21

(58) Field of Classification Search ..... 165/104.26, 165/104.21, 185; 361/700; 257/715
See application file for complete search history.

(56) References Cited

U.S. PATENT DOCUMENTS

| | | | | |
|---|---|---|---|---|
| 4,660,625 | A * | 4/1987 | Musinski | 165/47 |
| 4,884,627 | A * | 12/1989 | Abtahi | 165/104.26 |
| 5,268,812 | A * | 12/1993 | Conte | 361/698 |
| 5,386,143 | A * | 1/1995 | Fitch | 257/715 |
| 5,720,339 | A * | 2/1998 | Glass et al. | 165/104.26 |
| 2002/0117292 | A1 * | 8/2002 | Heikkila et al. | 165/104.11 |
| 2004/0123980 | A1 * | 7/2004 | Queheillalt et al. | 165/133 |

* cited by examiner

*Primary Examiner*—Teresa J. Walberg

(57) ABSTRACT

Invention disclosures novel design of structural components and fasteners that in addition to sound mechanical strength reveal excellent thermal characteristics, which allows using them as super efficient heat sinking/management solutions.

7 Claims, 1 Drawing Sheet

INTEGRAL FASTENER HEAT PIPE

RELATED APPLICATION DATA

This application is a continuation-in-part of each of:

1) U.S. patent application Ser. No. 11/306,530, filed Dec. 30, 2005, entitled "Heat pipes utilizing load bearing wicks", hereby incorporated by reference 2) U.S. patent application Ser. No. 11/306,529, filed Dec. 30, 2005, entitled "Perforated heat pipes", hereby incorporated by reference 2) U.S. patent application Ser. No. 11/307,051, filed Jan. 20, 2006, entitled "Process of manufacturing of spongy heat pipes", hereby incorporated by reference

FIELD OF INVENTION

This invention presents novel fastener design that embeds integral heat pipe structure throughout its volume. The fastener this way executes two functions: (i) securing components of a construction or an assembly, and (ii) efficiently transferring significant heat fluxes between the components.

Heat pipes and similar devices that utilize phase transitions of liquids and are essentially use heat pipe principles were used vastly in engineering of engines, motors, boilers, ovens, exhausts, and many other apparatuses that encounter significant density of generated heat energy. These devices are used in two ways: (i) they either integrated into design of the apparatus, or (ii) attached to the apparatus to establish heat link with another body. In either case heat pipe itself does not bear primary mechanical load and additional fastening structures establish mechanical fastening of the apparatus.

Traditional heat pipes are limited in their mechanical strength, as by design, they are hollow structures usually shapes as a pipe or a ribbon. Ribbon geometry does not provide significant shape stability and commonly uses for flexible designs. The pipe shape does not allow for convenient fastening and always requires additional fasteners and hardware to perform its operations.

DETAILED DESCRIPTION

This invention creates fasteners that provide significant mechanical strength and powerful heat transfer capacity. Its preferred embodiments show rigid design and shock dampening design. Invention utilizes benefits of two prior inventions Ser. No. 11/306,529 and Ser. No. 11/306,530 that disclose load bearing design of heat pipes and perforated or sponge like heat pipe design. It also relies on production method disclosed in invention Ser. No. 11/307,051.

These disclosures enable creation of arbitrary shaped heat pipe type devices that unlike traditional heat pipes reveal significant surface area. This invention employs these devices and embeds them into volume of a solid substance. In first preferred embodiment this substance is high temperature silicone rubber.

Alternatively a plurality of small discontinuous heat pipes or similar devices can be used in a similar way (term heat pipe stands for a sealed volume containing at least a mix of a liquid and its vapors). They can be poured together in ordered or unordered fashion and solidified/united by means of a solid substance via molding, laminating or other process. Resulting device will have the same mechanical and slightly inferior thermal characteristics yet sufficiently similar to consider it within the scope of this invention.

FIG. 1 shows an example of shock absorber for combustion engine. It is designed to interface directly with wall of combustion chamber (cylinder). Construction material is sponge like heat pipe molded with high temperature silicone rubber into desired shape. Bolted connections are used to attach cylinder block on one side and chassis of a machine on the other side. Broken view shows inner volume of the part. It is occupied by unordered mesh of heat pipe where all voids are filled with silicone rubber. Such a construction has high mechanical strength that allows direct bolt connections and sufficient elasticity that reduces chassis vibrations caused by the engine.

The same geometry if executed as a standard heat pipe will have poor mechanical strength and would collapse under load of bolts and the engine weight.

Second preferred embodiment uses electroplated aluminum and alumina particles composite instead of molding compound. Final structure resembles porous metal but have branches of the heat pipe embedded in it. Resulting part has high tensile and compression strength and light weight, yet its thermal conductivity exceeds one of graphite fibers. Implemented technique allows for high structural loads on the part due to its advanced geometry. Parts like can be used as a fasteners and structural elements in jet engines, gas turbines, electric motors etc.

FIG. 2 show implementation of this embodiment in micro motor applications. High speed micro electric motors can provide significant specific power up 100 times exceeding those of large industrial motors, but this power quickly overheat them. Invented fastener provides no weight overhead comparing with ordinary fasteners, yet it sinks more heat than any ordinary heat sink. Chassis of the craft dissipate this heat flux by passive heat transfer. Implementing similar approach with regular heat pipe solution would create weight overhead caused by weight of a heat pipe and mounting hardware.

Discontinued heat pipes can be produced by cutting a long capillary heat pipe onto plurality of short segments while sealing their ends. This discontinued segment can be as narrow as 0.8 mm or even less and 5 mm to several centimeters long. These fragments can form a felt like structure or be parked in yarns or other ordered layouts. For subject of this invention it is not essential whether a perforated- or spongy-heat pipe or plurality of discontinued heat pipes employed inside the part of described embodiments.

This invention provides great usability and functional benefits to high energy density engineering designs ranging from micro-robotics and mobile electronics to industrial equipment and aero-space.

Figure 1:
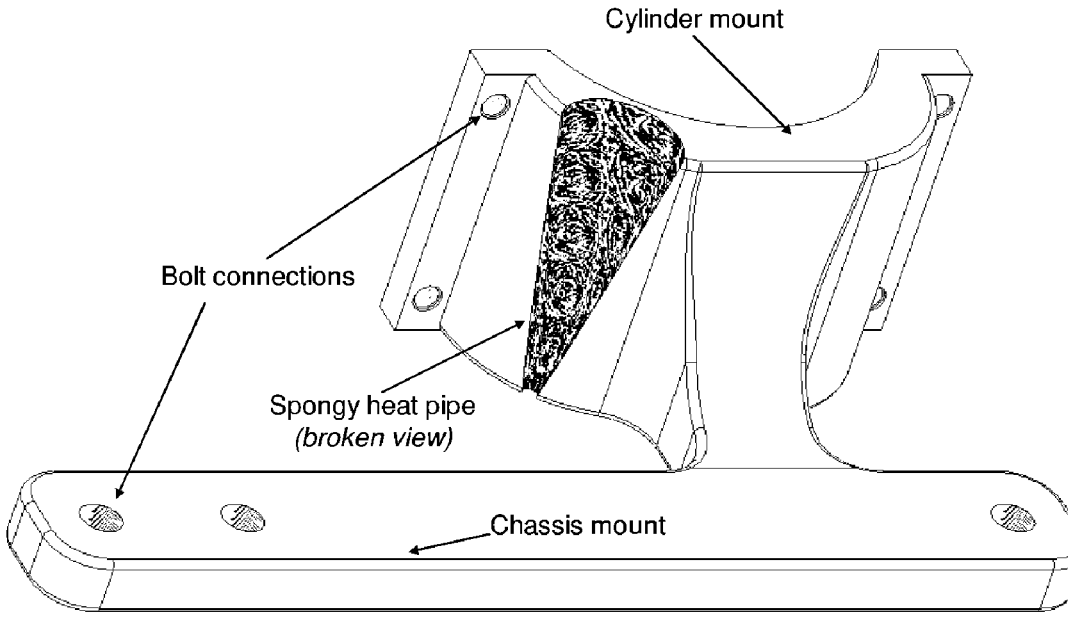
FIG. 1 shows an example of harness with high mechanical strength and exceptional thermal conductance. Part of exterior finish is shown as removed to illustrate inner fibrous composition. Each of shown fibers is micro heat pipe.
Figure 2:
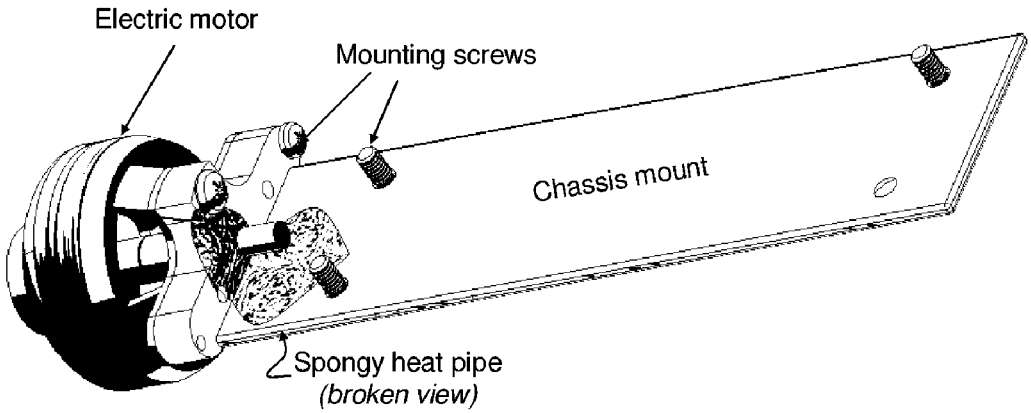
FIG. 2 shows an example of harness that simultaneously plays role of a radiator. Monolithic design was machined from block of material with embedded micro heat pipes.

What is claimed is:

1. A device comprising a plurality of heat pipes molded or otherwise embedded into continuous material, wherein said material occupies all residual volume of the device geometry, and encases said plurality, wherein said geometry is a fastener or other structural form that enforce a mechanical constraint between a set of entities, wherein said set has more than one entity, and said plurality contains either: (i) at least one perforated or spongy heat pipe; or (ii) at least one heat pipe with load bearing wick structure; or (iii) more than two of discontinuous heat pipes where each of them is in direct thermal contact with at least one other member of said plurality.

2. A device of claim 1 wherein said continuous material is a composite.

3. A device of claim 1 wherein said continuous material is a composite and content of this composite differs through the device.

4. A device of claim 1 wherein said continuous material is a composite and part of its structural volume is essentially void.

5. An engine or a motor that perform as at least one of said entities of claim 1.

6. An apparatus comprising an entity of claim 5 and staging as one of said entities of said set.

7. A gas turbine or a jet engine that perform as at least one of said entities of claim 1.

* * * * *